US007040777B2

(12) United States Patent
Yuen

(10) Patent No.: US 7,040,777 B2
(45) Date of Patent: May 9, 2006

(54) ILLUMINATION DEVICE AND SIREN, HAVING A PULL-ROPE ACTIVATION

(76) Inventor: Se Kit Yuen, 6/F., Yau Lee Centre, 45 Hoi Yuen Road, Kwun Tong, Kowloon (HK)

( * ) Notice: Subject to any disclaimer, the term of this patent is extended or adjusted under 35 U.S.C. 154(b) by 147 days.

(21) Appl. No.: 10/648,895

(22) Filed: Aug. 27, 2003

(65) Prior Publication Data

US 2004/0042204 A1 Mar. 4, 2004

(30) Foreign Application Priority Data

Aug. 29, 2002 (CN) ..... 2002 3 38236
Nov. 18, 2002 (CN) ..... 2002 2 85811 U

(51) Int. Cl.
*F21L 4/02* (2006.01)

(52) U.S. Cl. ..... 362/184; 362/228; 362/234

(58) Field of Classification Search ..... 362/184, 362/253, 86, 102, 103, 109, 119, 120, 157, 362/202, 204, 205, 208, 228, 183, 227, 234; 340/286.01, 384.1
See application file for complete search history.

(56) References Cited

U.S. PATENT DOCUMENTS 1,738,243 A * 12/1929 Hedberg ..... 362/253
2,642,520 A * 6/1953 Coolidge et al. ..... 362/183
3,825,740 A * 7/1974 Friedman et al. ..... 362/183
4,045,663 A * 8/1977 Young ..... 362/253
4,321,657 A * 3/1982 Hoi ..... 362/183
4,325,107 A * 4/1982 MacLeod ..... 362/183
4,535,392 A * 8/1985 Montgomery ..... 362/253
4,665,389 A * 5/1987 Clendening ..... 340/574
4,703,402 A * 10/1987 Hsieh ..... 362/102
4,835,665 A * 5/1989 Kao ..... 362/184
4,977,489 A * 12/1990 Fung ..... 362/184
5,217,297 A * 6/1993 Yuen ..... 362/184
5,325,085 A * 6/1994 Decker ..... 340/574
5,461,551 A * 10/1995 Clayton ..... 362/183
5,578,992 A * 11/1996 Harding ..... 362/253
5,617,075 A * 4/1997 Worth et al. ..... 340/574
5,859,582 A * 1/1999 Yuen ..... 362/184
5,903,219 A * 5/1999 Chen ..... 340/574
6,533,434 B1 * 3/2003 Yuen ..... 362/184

* cited by examiner

*Primary Examiner*—Sandra O'Shea
*Assistant Examiner*—Ismael Negron
(74) *Attorney, Agent, or Firm*—Akerman Senterfitt

(57) ABSTRACT

An electric lamp, which has a long-life focus lamp, a long-life cold cathode lamp, a long-life siren lamp and a siren for asking for help. The lamp body has an inner chamber with a focus lamp unit chamber disposed at its upper end, a cold cathode lamp unit chamber at the front end of the lamp body and a flash lamp unit chamber at the back end of the lamp body. An electric source circuit is accommodated in the inner chamber of the lamp body and the siren is operable by a hand-held rope.

6 Claims, 5 Drawing Sheets

ILLUMINATION DEVICE AND SIREN, HAVING A PULL-ROPE ACTIVATION

FIELD OF THE INVENTION

The present invention relates to a type of hand-held lamp, and also relates to a lamp powered by battery or commercial electricity.

OBJECT OF THE INVENTION

The purpose of the present invention is to provide an improved design to his type of lamp, and which could provide to the user with energy savings, be easy to carry and enable a user to ask for help by using a siren.

SUMMARY OF THE INVENTION

According to the present invention, there is provided a type of lamp, which includes a lamp body with at least three light sources, and siren and a rope ring handle. The lamp body has an inner chamber with a focus lamp unit chamber disposed at its upper end, a cold cathode lamp unit chamber at the front end of the lamp body and a flash lamp unit chamber at the back end of the lamp body. An electric source circuit is accommodated in the inner chamber of the lamp body and the siren is operable by a hand-held rope. The light source can illuminate continuously over two days with the power supplied by the general battery, and also does not need to replace the lamp within 100,000 hours in use. The lamp can provide to the user with energy savings, it is easy to carry and can ask for help by use of the siren.

BRIEF DESCRIPTION OF THE DRAWINGS

The additional technical features of the present invention are explained in details as follows in combination with the drawings, in which.

DESCRIPTION OF THE PREFERRED EMBODIMENT

Figure 1:
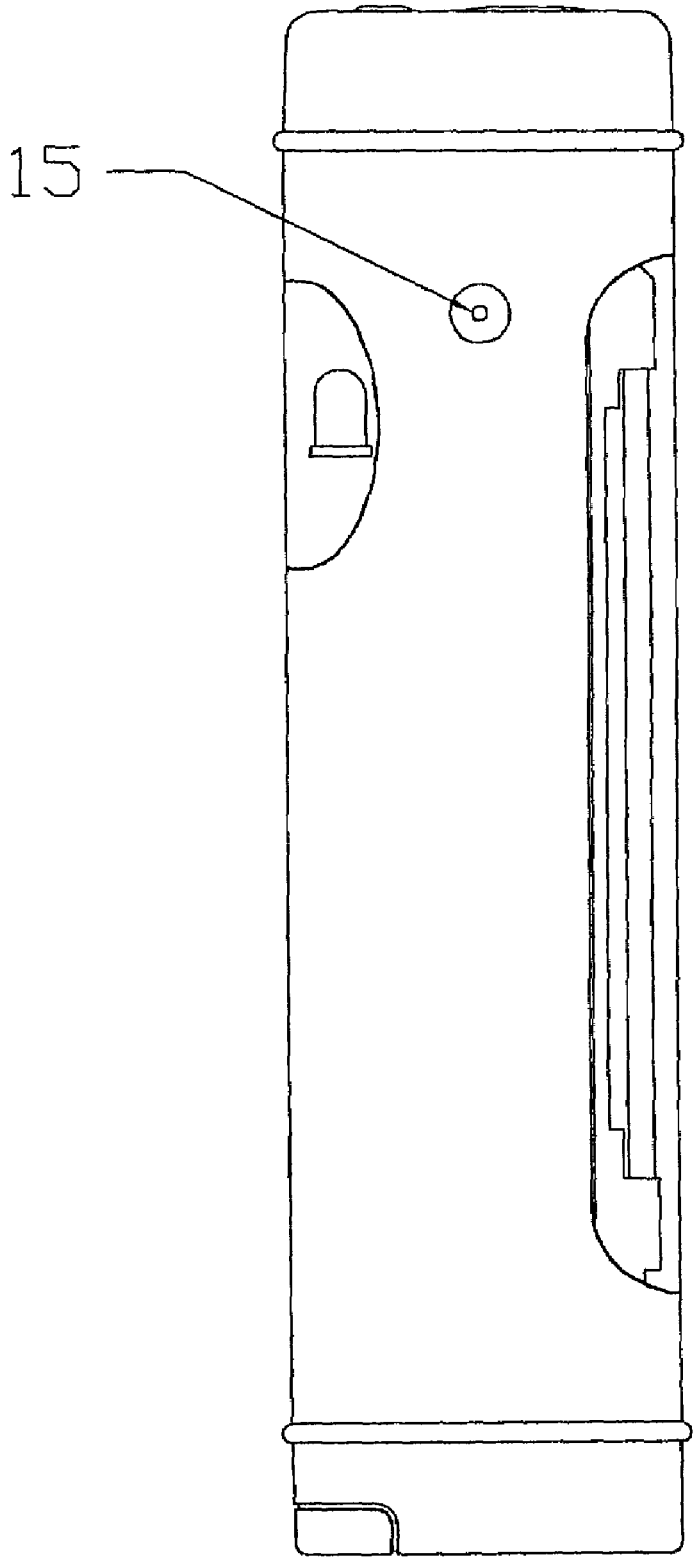
FIG. 1 is the side view of the lamp according to the present invention.
Figure 2:
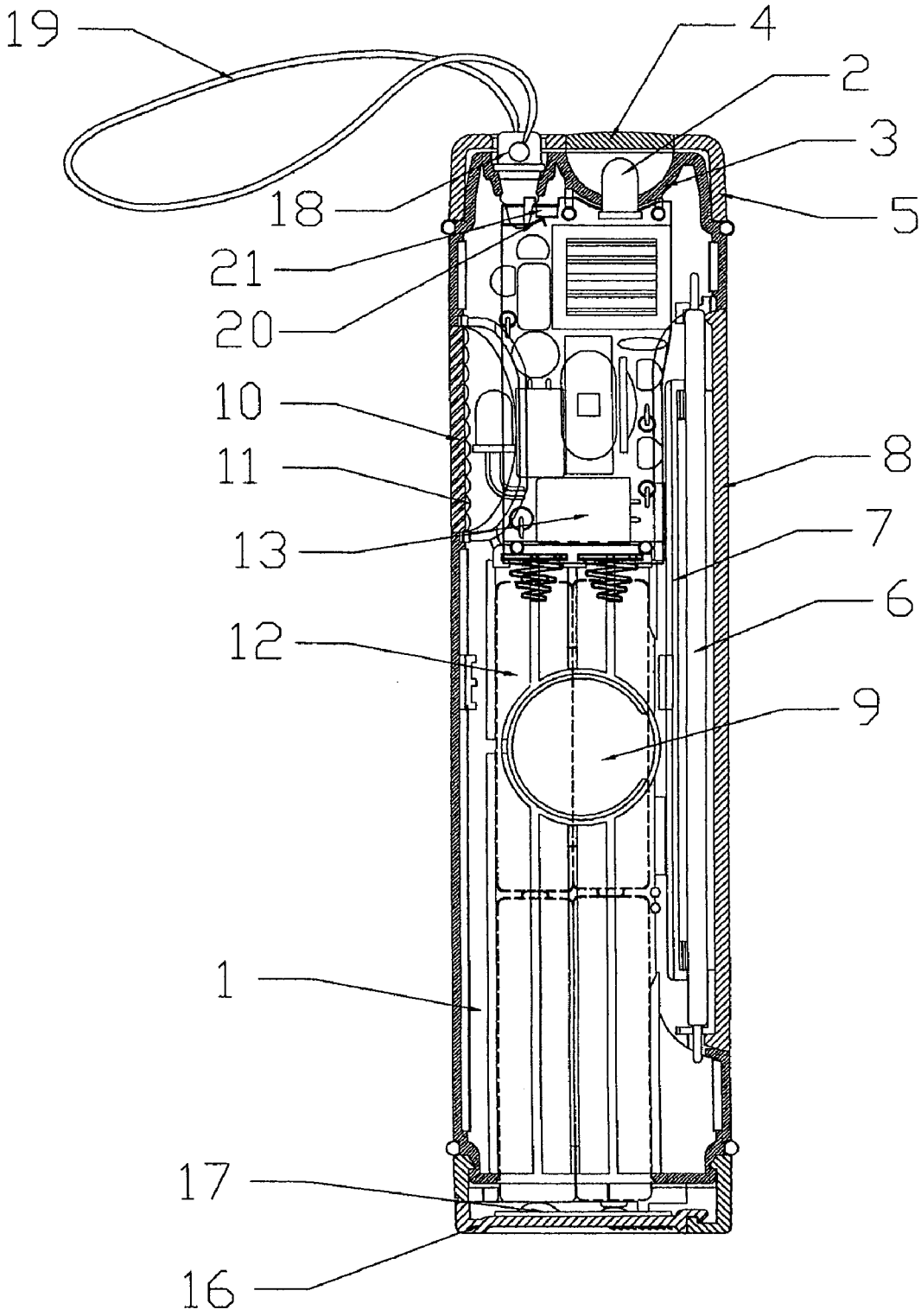
FIG. 2 is the longitudinal sectional view of the lamp shown in FIG. 1.
Figure 3:
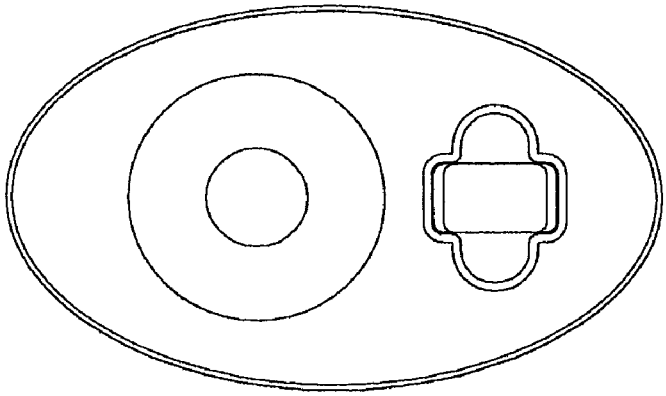
FIG. 3 is the top view of the lamp shown in FIG. 1.
Figure 4:
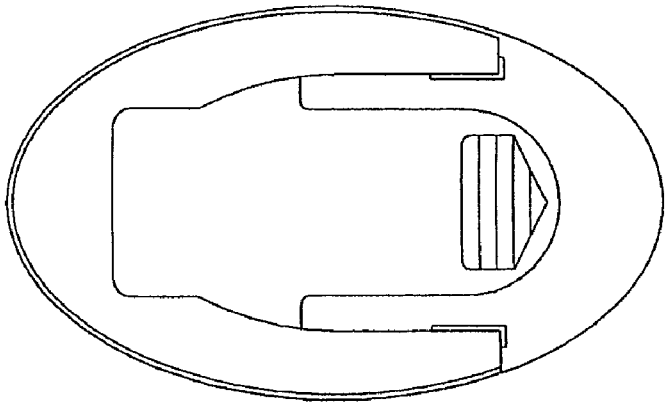
FIG. 4 is the bottom view of the lamp shown in FIG. 1.
Figure 5:
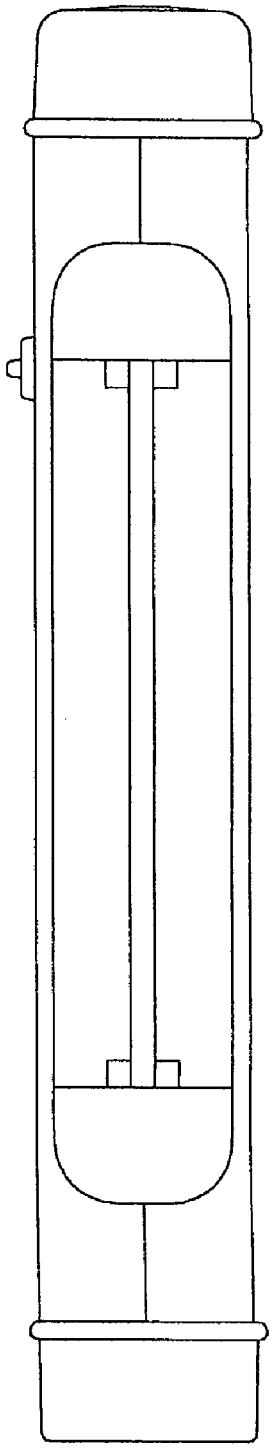
FIG. 5 is the front view of the lamp shown in FIG. 1.
Figure 6:
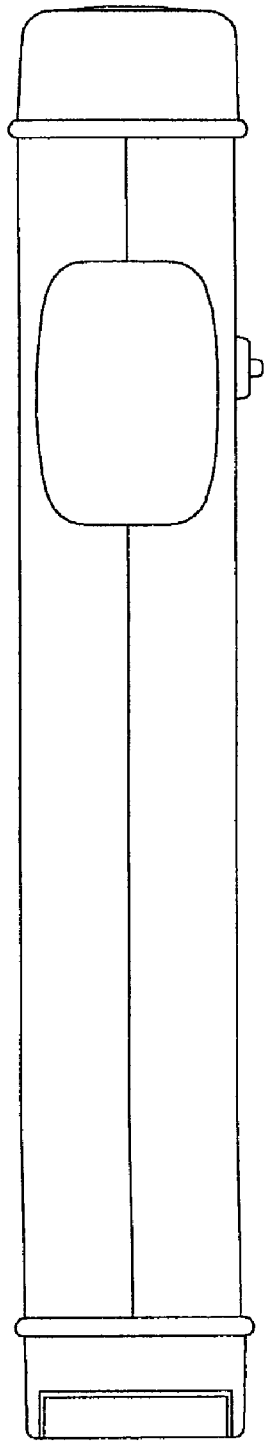
FIG. 6 is the back view of the lamp shown in FIG. 1.
Figure 7:
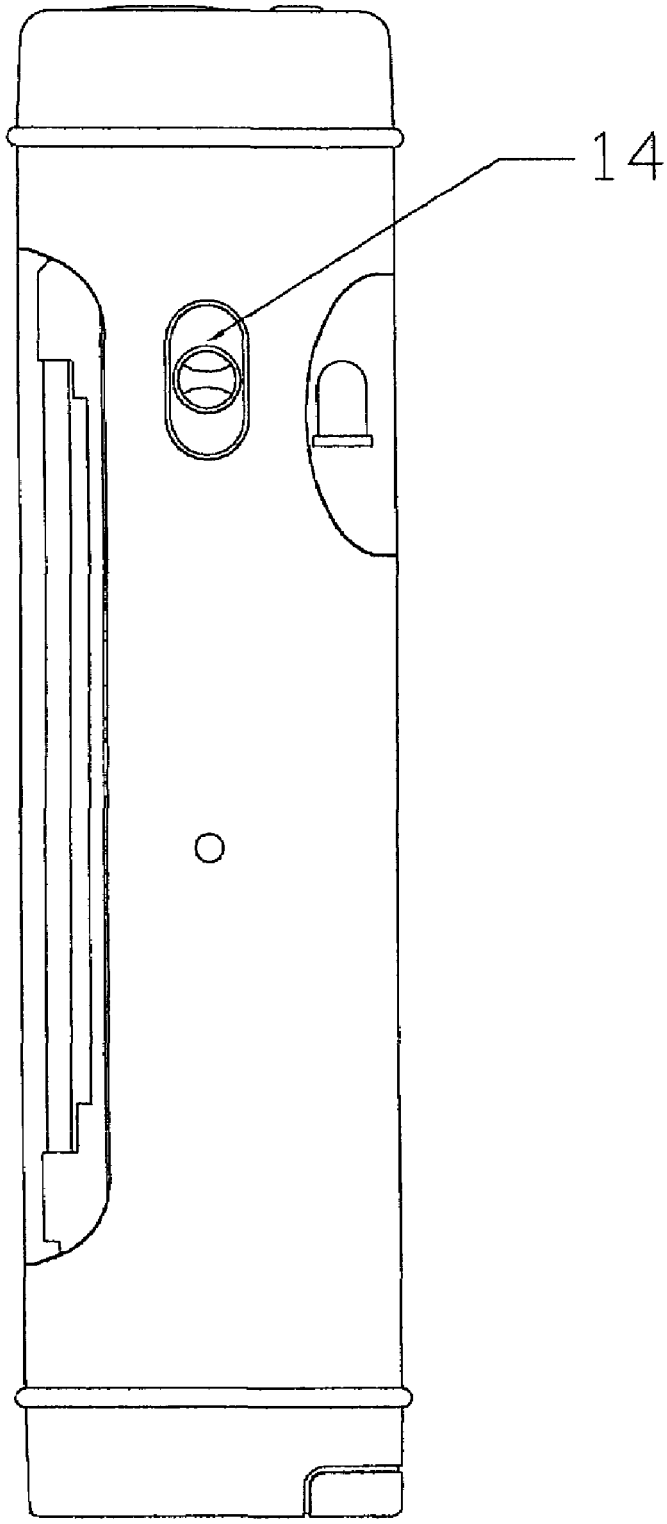
FIG. 7 is another side view of the lamp shown in FIG. 1.

The lamp of the present invention generally includes the lamp body (1) having a rectangular shape, a light source (2) disposed at the upper end in the lamp body, a viewfinder surface (3) having a paraboloid shape and a projecting plate (4) made of glass or other transparent material. The viewfinder surface (3) and the projecting plate (4) form a focus lamp unit chamber. The projecting plate (4) is generally in a paraboloid shape and functions for converging the light. The inner side surface of the projecting plate (4) is sealed with the end surface within a front ring-shape lamp cap (5) which is mounted on the upper end of the lamp body (1). One end of the lamp body (1) has an elongated light source (6), and a viewfinder (7) which is generally a flat surface for reflecting and strengthening the light source, and a light-permeating cover (8) made of glass or other transparent material, the said light-permeating cover (8) being disposed at the front end of the lamp body (1). The light source (6) is preferably a fine and long-life cold cathode fluorescent lamp, which does not need to be replaced. The viewfinder (7) and the light-permeating cover (8) form a cold cathode lamp unit chamber.

A flash light cover (10), which is made of glass, other transparent material or semi-transparent material covers a lamp bulb. The flash light cover (10) has a ball body (11) for diffusing the refraction, which scatters the refraction of the light source. The flash light cover (10) is disposed at the back end of the light body (1). The flash light cover (10) forms a flash lamp unit chamber with a surface provided underneath the lamp.

As shown in the Figs, at least three light sources of the light body (1) are lamps which are powered by the electrical source (12) in the light body (1). The electrical source is connected with an electrical source circuit (13) in the lamp body (1) through an electrical line and connected to an outside socket (15). A kinetic energy switch (14) is connected with the lamp. Obviously, the light source could be powered by battery or by rechargeable battery, the direct electrical source is connected with charger, and the electrical source circuit in the lamp body (1) is for charging. The lamps emit light but do not generate heat, thus making the lamp safe and even suited for little children.

As shown in the Figs, there is a battery hatch at the lower end of the lamp body (1), the battery hatch (16) is the entrance and exit of the battery. A contacting metal plate (17) at the upper end of the battery hatch (16) is for turning on the battery. The battery hatch (16) is detachably fixed at the lower end of the lamp body (1).

The lamp body can include a ring made of rubber or other elastic material at the upper and lower ends, the rubber ring making it easy for a user to hold the lamp, and providing shock resistance to the lamp body.

There is a pull switch button (18) at the upper end of the lamp body (1), and a rope (19) handle is linked at the end of the said pull switch button (18). The pull switch button (18) is detachably fixed at the upper end of the lamp body (1). Metal deformable plates (20) and (21) are separated while the pull switch button (18) being fixed at the upper end of the lamp body (1), but when the pull switch button (18) is separated from the lamp body (1), the metal deformable plates (20) and (21) are jointed together due to the elasticity of the metal itself, therefor the electric energy is generated to turn on the siren and which leads to the buzzer (9) to sound an alarm. Thus, when the user of the lamp is in a dangerous situation, the pull switch button (18) of the rope handle is pulled by the user, then the siren sends the information of asking for help.

In other words, the multi-functional cold cathode lamp of the present invention could be used as flashlight, and is also easy to hold by hand or to carry in a person's pocket. The multi-functional cold cathode lamp of the present invention can focus illumination over a long distance, and can illuminate in different angles over a short distance, and can send signal light in different frequencies. This is very useful for protecting women's safety or for people when traveling.

What is claimed is:

1. A hand-held multi-functional cold cathode lamp, comprising:

a lamp body which has an inner chamber;

at least three light sources including a focus lamp unit disposed at an upper end of the inner chamber, a cold cathode lamp unit at the front end of the lamp body, and a flash lamp unit at the back end of the lamp body;

an electric source circuit accommodated in the inner chamber of the lamp body;

a rope handle attached to the lamp body, and a siren operable by pulling the rope handle, wherein in the inner chamber there is an arcuate reflecting unit for focusing light from the focus lamp unit, and a planar reflecting unit for diffusing light from the flash lamp unit.

2. The hand-held multi-functional cold cathode lamp according to claim 1, wherein in the inner chamber there are at least one switch, at least one socket for an outside power source, and a pull switch hook pulled by the rope handle.

3. The hand-held multi-functional cold cathode lamp according to claim 1, wherein the said at least three light sources can be used continuously more than 100,000 hours.

4. The hand-held multi-functional cold cathode lamp according to claim 1, wherein the said lamp body includes a ring made of rubber or other elastic material at the upper and lower ends, said ring being easy for user to hold and having a shock resistance function.

5. The hand-held multi-functional cold cathode lamp according to claim 1, wherein the cold cathode lamp unit comprises a long-life cold cathode fluorescent lamp.

6. The hand-held multi-functional cold cathode lamp according to claim 1, wherein the light sources are sealed by transparent or semi-transparent materials to protect a user from heat dissipated from the light sources.

* * * * *